US005554826A

United States Patent [19]

Gentry

[11] Patent Number: 5,554,826

[45] Date of Patent: Sep. 10, 1996

[54] OVERHEAD TRANSMISSION CONDUCTOR

[75] Inventor: Bobby C. Gentry, Carrollton, Ga.

[73] Assignee: Southwire Company, Carrollton, Ga.

[21] Appl. No.: 352,122

[22] Filed: Dec. 1, 1994

Related U.S. Application Data

[63] Continuation of Ser. No. 115,606, Sep. 3, 1993, Pat. No. 5,374,783, which is a continuation of Ser. No. 904,116, Jun. 25, 1992, Pat. No. 5,243,137.

[51] Int. Cl.[6] ..... H01B 5/08

[52] U.S. Cl. ..... 174/128.1; 174/129 R; 174/130; 174/133 R; 29/825; 29/828

[58] Field of Search ..... 174/128.1, 129 R, 174/130, 133 R; 29/825, 828; 156/47, 50; 57/214, 215

[56] References Cited

U.S. PATENT DOCUMENTS

| | | | |
|---|---|---|---|
| 1,943,087 | 1/1934 | Potter et al. | 174/128.1 |
| 3,231,665 | 1/1966 | Grimes, Jr. et al. | 174/108 |
| 3,676,578 | 6/1972 | Cahill | 174/128.1 |
| 3,760,093 | 9/1973 | Pemberton | 174/128.1 |
| 3,813,481 | 5/1974 | Adams | 174/130 |
| 3,813,772 | 6/1974 | Adams | 174/102 R |
| 4,843,696 | 7/1989 | Gentry et al. | 174/36 |
| 5,074,140 | 12/1991 | Sanders | 174/72 |
| 5,133,121 | 7/1992 | Birbeck et al. | 29/872 |
| 5,243,137 | 9/1993 | Gentry | 174/128.1 |
| 5,374,783 | 12/1994 | Gentry | 174/128.1 |

*Primary Examiner*—Kristine L. Kincaid
*Assistant Examiner*—Chau N. Nguyen
*Attorney, Agent, or Firm*—Stanley L. Tate; James W. Wallis, Jr.

[57] ABSTRACT

An electrical overhead transmission conductor cable having a steel reinforcing core which exhibits improved characteristics and unexpected conductivity above about 64% IACS is manufactured of a steel core covered by at least one stranding layer which is formed of round or trapezoidal shaped wire strands subjected to annealing before heat treatment and drawn and stress-relieved/annealed after stranding is completed, to provide a finished cable which includes an aluminum conductive portion which is dead soft, or "O" temper. The steel core of the cable carries substantially the entire tension load of both the core and conductors when suspended between vertical towers. The overhead transmission cable may be formed of trapezoidal cross section conductors wires for improved vibration performance characteristics.

8 Claims, 3 Drawing Sheets

OVERHEAD TRANSMISSION CONDUCTOR

This is a continuation of application Ser. No. 08/115,606, filed Sep. 3, 1993, now U.S. Pat. No. 5,374,783 which was a continuation of application Ser. No. 07/904,116, filed Jun. 25, 1992, now U.S. Pat. No. 5,243,137, issued Sep. 7, 1993.

TECHNICAL FIELD

The present invention relates to electrical overhead transmission conductors, and especially a steel supported aluminum overhead transmission conductor, or cable. More particularly, the present invention is directed to a method of manufacturing an improved steel supported aluminum overhead transmission conductor cable with unexpectedly improved conductivity and increased current carrying capacity (ampacity), as well as improved self-damping characteristics, and to the aluminum overhead conductor cable manufactured thereby. Both round and trapezoidal wire cross section configurations are disclosed. Better corrosion resistance and high-temperature operation performance is accompanied by improved thermal-related sag, reduced tension creep, and increased fatigue resistance characteristics arising from the disclosed method of manufacture. Certain characteristics of the overhead transmission conductor are enhanced when the aluminum wire strands are of trapezoidal cross section.

BACKGROUND OF THE INVENTION

Steel reinforced aluminum cable (ACSR) for use as an overhead transmission conductor usually comprises a plurality of aluminum wires helically wound around a steel core, which is also typically formed of a plurality of usually round steel wires stranded together. A plurality of layers of aluminum strands are often used. The electrical strands are of electrical grade ("EC") aluminum, one or more aluminum alloys, or a combination of these, tempered to provide sufficient tensile strength to carry a portion of the suspended cable load.

High-voltage transmission companies face numerous problems in reducing costs and ensuring reliable power transmission to their customers. Among these are enormous losses of power due to electrical line losses, extremely expensive maintenance and replacement costs due to broken wires damaged by vibration and oscillation, and the ability to subject the transmission cables to increased loads beyond those for which the cable system may have been designed, if only temporarily, as occurs during peak load conditions or when used to carry the load of a companion circuit that has been temporarily removed from service for maintenance, etc. The known cable standards and constructions represent a compromise among many competing service requirements, thus selection of cable presents an engineering problem of both considerable difficulty and long-term economic importance. The present invention reduces the complexity of the problem by providing in a single overhead transmission conductor a cable with superior conductivity, lower power losses, and greater ampacity for a given cable cross section, and very desirable service characteristics.

Standard ACSR overhead transmission conductor cable utilizes round electrically conductive wire strands. A portion of the tension resulting from the suspended weight of the cable is normally borne by the conventional ACSR aluminum electrical conductors under normal conditions. Under high temperature or high current-carrying operating conditions which soften aluminum wires, however, the steel strand may carry the entire mechanical tension load; the cable thus stretches and sags. ACSR cable is available in the conventional configuration with round conductor strands, and in reduced diameter to meet a "compact" specification. "Compact ACSR" is commonly found in one of two forms.

In one form, at least one layer of the electrical conductor is die-compacted following the stranding operation to reduce the cable cross-sectional area. U.S. Pat. Nos. 1,943,087 and 3,760,093 teach such processes. In another form, the individual strands used for at least one layer of aluminum conductors are shaped into a more compactly fitting cross section, a plurality of which are then fitted together to form the conductor layer or layers. The preferred cross-sectional shape for one embodiment of the invention is called trapezoidal wire. It is shaped before stranding to form the cable. Each compact cable construction relies on different manufacturing steps, and results in differing finished cable characteristics.

Die-compacted ACSR undergoes shaping forces during the compacting process which result in sharp corners or edges. These are susceptible to arcing or corona formation at higher voltage levels, and thus limit use of the configuration to lower voltage levels.

Trapezoidal wire ACSR is formed by "building up" preshaped conductors, resulting in a very dense structure without the mechanical rigidity of die-compacted ACSR. This cable construction can improve the resistance of the wire to aeolian oscillation and galloping, to which such conductors are subjected. Aeolian oscillation is a low amplitude, high frequency vibration that normally occurs due to relatively low wind velocities under 25 kilometers per hour. Galloping, conversely, is a low frequency, large amplitude phenomena. Both galloping and aeolian oscillation can contribute to fatigue and early failure of the conductors in conventional ACSR cable.

As noted, a portion of the tension force is normally carried by the aluminum conductor in ordinary ACSR. However, a condition known as "tension creep" elongation is known to occur, in which the aluminum conductor portion of the overhead cable stretches over time and permits a degree of conductor sag which may be undesirable. This can increase the load on the steel strand core since the tension force carried by the aluminum conductor is reduced without a reduction in the weight of the aluminum conductor.

Electrically conductive metals used for conductor cables are subjected to complex mechanical and heat treatments in order to arrive at desirable mechanical and electrical characteristics. As is well known, the interaction of the mechanical and heat treatments and the electrical characteristics is extremely complex; this complexity is vastly increased when the metal strands are subjected to the manufacturing process conditions necessary to produce a finished cable, installed for use. Tensioning, bending, and frictional heating of the aluminum conductor strands alter the electrical conductivity and temper thereof, often contrary to the finished effect desired.

U.S. Pat. Nos. 3,813,481 and 3,813,772 ("'481" and "'772") disclose known overhead transmission conductor cable designs in which the aluminum wires are at nearly dead soft temper and the stranded steel core carries substantially all of the tension load. This cable is denominated steel supported aluminum conductor, or SSAC. The '481 patent is believed to represent more recent improvements in overhead transmission conductor cable designs. In the design illustrated in that patent, the aluminum conductor wires are annealed to soft condition such that the stranded steel core carries the tensile load.

The manufacturing process for the SSAC product 100 disclosed in the '481 patent is illustrated in FIG. 4. Conventional 61% IACS aluminum rod 102 is drawn conventionally to wire form in a drawing step 104, then the drawn wire 106 is fully annealed in step 108. This drawn, fully annealed wire 110 is soft and easily subject to damage and must be handled carefully. This careful processing requirement extends to the special stranding step 112, where the conductor wires 110 are overlaid around the steel strand core 114.

Strain and work hardening as ordinarily and inherently occur in the stranding process must be minimized to avoid increasing the temper of the wires unnecessarily, as the finished overhead transmission conductor cable wires are specified as having less than 8500 pounds per square inch (psi) yield strength for 1 percent elongation and must provide at least 61% IACS conductivity in the final product. Therefore, the stranding step 112 described in the '481 patent includes numerous special processing condition requirements which necessitate extraordinary adjustments to the stranding apparatus and significantly slower processing speeds.

These special stranding step 112 requirements include, but are not limited to: applying a lubricant to the surface of the fully annealed aluminum wires, reducing the back-tension on the aluminum wires through the stranding machine, reducing the operating speed of the stranding machine, modifying the wire guides to minimize scuffing (which can cause scratches), enlarging the closure dies which press the annealed stranded wires against the steel core, and reducing the pressure of the closing dies. Even with these special stranding precautions, a degree of hardness is imparted to the aluminum conductor wires which requires careful attention, as the upper limits of the yield strength are prescribed at 8500 psi.

In addition to these uneconomical and difficult requirements and adjustments, extreme care must be exercised to protect the fully annealed wire 106 during the stranding step 108. That is, since the wire is dead soft, the surface is easily scratched or damaged; such scratches are an important cause of arcing and corona in the finished overhead transmission conductor cable. Special care and selection is required for overhead transmission cable intended for higher voltage service.

Of particular interest among the teachings of the '481 patent is that the product is to be subjected to only a single annealing step throughout the cable manufacturing process disclosed. The full anneal is to take place within the time frame illustrated at T11 of FIG. 4; i.e., after the drawing step 104 and before string-up 116 of the finished product is completed by placing it in regular service. Due to the deleterious effects of the high temperatures of the annealing process on the steel strand, the '481 patent teaches that the annealing step 108 is preferably performed within the time frame illustrated at T12 of FIG. 4, that is, after the drawing step 104 and before the special stranding step 112. It will be appreciated by those of ordinary skill in the art that a normal anneal occurring after stranding will negatively affect the performance characteristics of the steel strand.

These special manufacturing requirements add significantly to the cost of manufacturing this SSAC cable. No improvements in conductivity of the completed product are disclosed.

PRIOR ART EXAMPLES

Two samples of SSAC cable representing the prior art, as manufactured by the assignee of the '481, patent were obtained and submitted for analysis. One sample was SSAC 397 MCM (thousand circular mils) cross-sectional area and the other was SSAC 636 MCM cross-sectional area.

Several important standard characteristics of the conductor wires of each prior art cable sample were tested in accordance with accepted industry practice, including ultimate tensile strength, percent elongation, and conductivity. Several important characteristics of the steel strand core from the same SSAC prior art samples were also tested according to industry practices, including ultimate tensile strength, stress at 1 percent elongation, and percent elongation. The steel strands from both SSAC prior art sample cables conformed to ASTM Spec. B 606-79 for high strength steel core wire.

The 397 MCM sample was composed of six steel wires stranded over a single steel wire, a first inner layer of 8 round aluminum conductors, and a second layer of 14 round aluminum conductors. The conductor wire properties of the 397 MCM SSAC prior art example are given in Table I. Average values for the outer and inner layers of conductor wires are given, along with an average value of all 22 conductor wires. The electrical conductivity of each conductor wires was measured; the lowest- and highest-conductivity wires were both found in the outer layer, at 63.54% IACS to 63.92% IACS, respectively. Thus, the range of electrical conductivity variation among all conductor wires in the 397 MCM overhead transmission conductor cable was from 63.54% IACS to 63.92% IACS, or 0.38%.

The 397 MCM SSAC prior art sample steel strand wire properties are given in Table II; an average value for the steel strand outer layers is given as well as the inner strand value, along with an average of all 7 strands in the core.

The 636 MCM sample was composed of six steel wires stranded over a single steel wire, a first inner layer of 10 round aluminum conductors, and a second layer of 16 round aluminum conductors. The conductor and steel strand wire properties of the 636 MCM SSAC prior art sample are given in Tables III and IV, respectively. Average values for the outer and inner layers of conductor wires are given, along with an average value of all 26 conductor wires. The electrical conductivity of each conductor wires was measured; the lowest-conductivity wire was found in the inner layer, and the highest-conductivity wire was found in the outer layer, at 63.49% IACS to 63.74% IACS, respectively. Thus, the range of electrical conductivity variation among all conductor wires in the 636 MCM overhead transmission conductor cable was from 63.49% IACS to 63.74% IACS, or 0.25%.

TABLE I

SSAC 397 MCM

| Layer | Strand Diameter[1] | UTS[2] (KSI) | % Elong'n (10" Gage) | Conductivity (% IACS) |
|---|---|---|---|---|
| Outer (avg) | 0.135 | 9.0 | 31.8 | 63.7 |
| Inner (avg) | 0.135 | 8.9 | 28.4 | 63.8 |
| Overall (avg) | 0.135 | 8.9 | 31.3 | 63.7 |

Notes:
[1]Diameter in inches.
[2]Ultimate tensile strength.

TABLE II

| Layer | Strand Diameter[1] | UTS[2] (KSI) | Stress @ 1% Elong'n (KSI) | % Elong'n (10" Gage) |
|---|---|---|---|---|
| Outer (avg) | 0.074 | 245.1 | 231.2 | 4.5 |
| Core (avg) | 0.074 | 246.2 | 230.3 | 4.3 |

TABLE II-continued

| Layer | Strand Diameter[1] | UTS[2] (KSI) | Stress @ 1% Elong'n (KSI) | % Elong'n (10" Gage) |
|---|---|---|---|---|
| Overall (avg) | 0.074 | 245.3 | 231.2 | 4.5 |

Notes:
[1]Diameter in inches.
[2]Ultimate tensile strength.

TABLE III

| SSAC 636 MCM | | | | |
|---|---|---|---|---|
| Layer | Strand Diameter[1] | UTS[2] (KSI) | % Elong'n (10" Gage) | (% IACS) |
| Outer (avg) | 0.158 | 8.7 | 33.5 | 63.6 |
| Inner (avg) | 0.158 | 8.6 | 33.3 | 63.6 |
| Overall (avg) | 0.158 | 8.7 | 33.4 | 63.6 |

Notes:
[1]Diameter in inches.
[2]Ultimate tensile strength.

TABLE IV

| Layer | Strand Diameter[1] | UTS[2] (KSI) | Stress @ 1% Elong'n (KSI) | % Elong'n (10" Gage) |
|---|---|---|---|---|
| Outer (avg) | 0.121 | 235.8 | 218.7 | 4.6 |
| Core (avg) | 0.121 | 238.5 | 220.3 | 5.0 |
| Overall (avg) | 0.121 | 236.2 | 218.9 | 4.6 |

Notes:
[1]Diameter in inches.
[2]Ultimate tensile strength.

The '481 patent recognizes that it is necessary to use fully annealed conductors in SSAC to permit high temperature operation, and also recognizes that a normal anneal occurring after the stranding process subjects the steel strand core to high temperatures known to negatively affect the service properties of the steel strand core. Therefore, the '481 patent teaches that the annealing step is preferably performed after drawing and before stranding, and that the stranding be carefully performed to avoid undesirable work hardening in the conductor wires.

It is therefore a primary object of this invention to provide an overhead transmission conductor cable that exhibits improved electrical conductivity and meets or exceeds the product characteristics for overhead transmission conductor cables without requiring the extraordinary stranding apparatus adjustments of the prior art manufacturing processes, thereby reducing manufacturing costs.

It is an object of the present invention to provide an improved aluminum overhead transmission conductor cable which exhibits surprising improved conductivity in combination with superior performance characteristics.

A further object of the present invention is to provide a method of manufacturing the improved overhead transmission conductor cable.

It is also an object of the present invention to provide a method of manufacturing the improved aluminum overhead transmission conductor cable without extraordinary, slow, and expensive processing requirements.

A feature of the cable of this invention is that it may easily be manufactured on conventional equipment at normal operating speeds, reducing costs.

Other characteristics of the cable produced according to this invention include improved self-damping, corrosion resistance, reduced electrical losses and greater current capacity for a given cable cross section, high temperature operation, reduced tension creep, and improved thermal-related sag resistance characteristics. An advantage of the present invention is significant material cost savings, consistent with a high quality cable product.

Another advantage of the present invention is that the novel overhead transmission conductor cable can be readily manufactured on conventional cable manufacturing equipment, requiring only the addition of a stress-relief/anneal step and equipment after the stranding operation is completed, which may be simply bypassed and not used when manufacturing other cable configurations on the same equipment line.

SUMMARY OF THE INVENTION

According to the present invention, an overhead transmission conductor cable is manufactured using essentially conventional process steps in order to produce a cable product of improved characteristics, and especially an unexpectedly improved high conductivity level.

Prior art SSAL overhead transmission conductor cables have a conductivity level of about 63% International Annealed Copper Standard (IACS). Overhead transmission conductor cable according to the present invention exhibits superior conductivity, generally exceeding 64% IACS. This conductivity level more closely approaches the theoretical aluminum conductivity limit of about 65% IACS. Because the conductivity is so nearly that of the theoretical maximum value attainable, the variation in conductivity values between individual wires is reduced compared to that of prior art cables of lower conductivity, thus providing improved uniformity among the conductor wires.

The improved high conductivity overhead transmission conductor cable manufacturing process generally includes the preliminary step of supplying a stranded steel core which meets applicable standards. The steel core strands may be covered with a protective coating, such as aluminum or zinc, in order to prevent undesirable deterioration of the steel core in the operating environment. An aluminum coating is preferred for reducing hysteresis losses and for improved higher temperature performance, especially in the heat-treating stages of manufacture.

Manufacture of the aluminum strands which overlie the steel core is accomplished as follows. First, 99.8% purity aluminum is selected to maximize the conductivity in the finished product. Raw aluminum metal of this purity is normally chosen to make electrical conductor grade products of, for example, only 62% IACS conductivity; since this material is readily available, it is selected for manufacture of the aluminum rod product from which the present conductor strands are to be made. The rod is preferably continuously cast and rolled normally to form a rolled rod product. The aluminum rod product is then fully annealed by conventional methods at an elevated temperature for a time period sufficient to assure recrystallization resulting in a reduction of the tensile strength to approximately 9.0 kilopounds per square inch (ksi).

The annealed rod is next formed to the desired size. It may, for example, be drawn to the desired size which introduces strain hardening, of a strength in the range of 20.0 ksi. The overhead conductor is formed of layers of wire which may have either a round or other cross section, including a trapezoidal cross section. When the conductor wires are formed of a trapezoidal cross section, the resulting cable diameter can be reduced for a given current capacity rating, increasing the ampacity rating of the overhead transmission conductor cable. Trapezoidal cross section wires have also been found to improve other service characteristics of the finished cable, including self-damping resistance to aeolian vibration and galloping, and creep.

Trapezoidal shaped wires may be formed by drawing or by preshaping round wire or rod with rollers in one or more reshaping steps. This reshaping may be performed in addition to cross section reduction by drawing. Such shaping operations normally take place prior to the stranding operation, but may be performed as a step relating to the stranding operation.

The stranding operation forms the aluminum conductor wires into at least one layer having a spiral twist, or lay, over the stranded steel cable which forms the core. One or more additional layers may be added until the cable construction is completed. The normal stranding operation adds a slight degree of work hardening due to the tensions and mechanical forces inherent in the stranding operation. Stranding is completed before the product is subjected to heat treatment.

As a result of hardening occurring before and during the drawing and stranding processes, the aluminum components of the cable are not at the desired "O" temper or dead soft condition following stranding. The overhead transmission conductor is therefore subjected to a stress-relieving/annealing heat treatment to produce a dead soft condition in the aluminum components. This must be accomplished without undesirably affecting the steel strand core or its protective coating.

Properly performed, these process steps will produce an aluminum overhead cable having a surprisingly high conductivity of about 64% IACS or greater, improved self damping, better corrosion resistance and high-temperature operation performance, accompanied by improved thermal-related sag, reduced tension creep, and increased fatigue resistance characteristics. Conductor wires produced accordingly exhibit more consistent conductivity levels with little variation among individual conductor wires.

BRIEF DESCRIPTION OF THE DRAWINGS

The features and advantages of the present improved overhead transmission conductor cable will be more clearly appreciated from the following description of the preferred embodiment of the invention taken in conjunction with the accompanying drawing figures, in which like reference numerals indicate like elements, and wherein.

DETAILED DESCRIPTION OF THE PREFERRED EMBODIMENT

Figure 1:
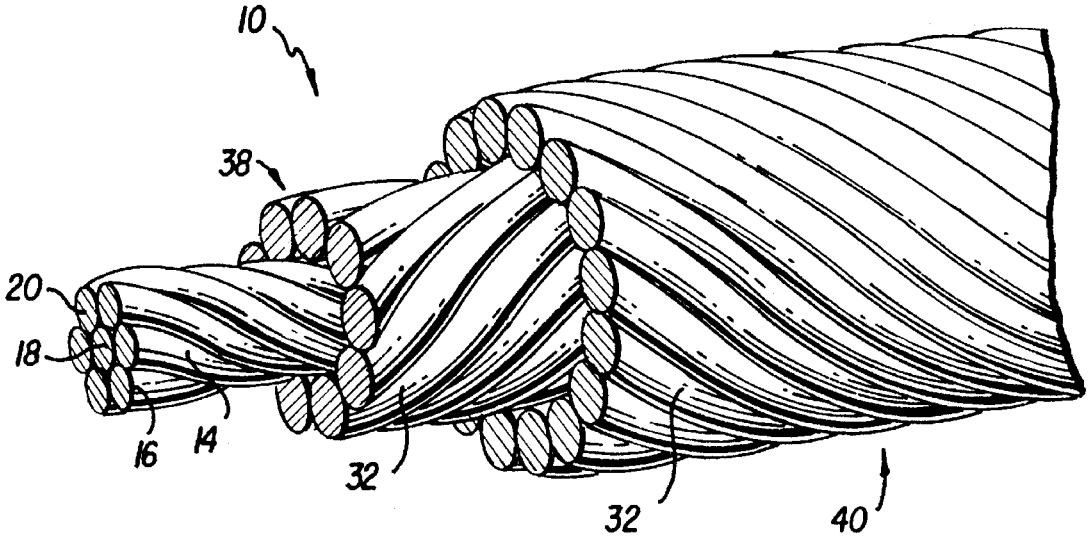
FIG. 1 is a perspective view of an overhead transmission conductor cable having round wire strands to illustrate a cable construction according to this invention, in which the outer conductor layers are selectively removed to show the cable structure.
Figure 2:
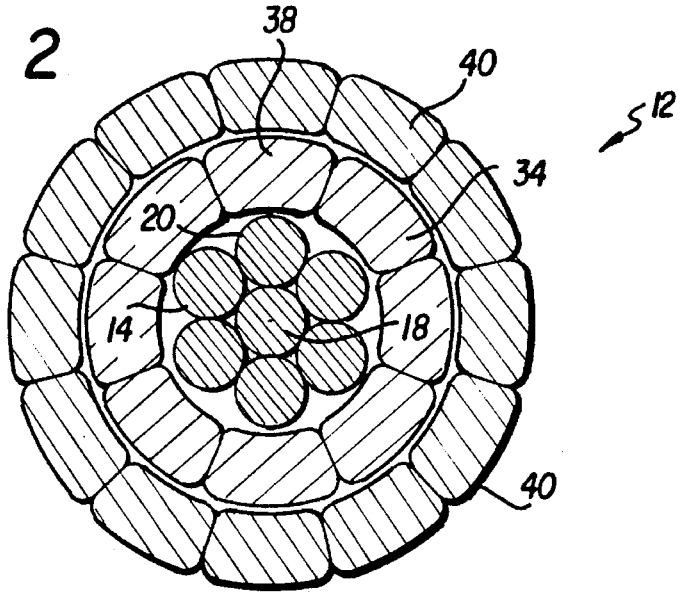
FIG. 2 is a cross section view of another, similar overhead transmission conductor cable which has trapezoidal wire strands, illustrating a cable construction according to this invention.

An overhead transmission conductor cable 10 of round wire is shown in FIG. 1 and an overhead transmission conductor cable 12 of trapezoidal wire is shown in FIG. 2. Except for the individual wire cross sections and the finished product ampacity characteristics, the processing steps are substantially identical. For clarity, both configurations are shown with round steel core wire strands; however, other steel core wire strand cross sections may be substituted as desired.

A stranded steel core 14 is required for support of the overhead transmission conductor cable 10, 12. The individual steel core strands may be covered with a protective coating 16, such as aluminum or zinc, in order to prevent undesirable deterioration of the steel core 14 in the intended operating environment. A common overhead transmission conductor configuration uses a central strand 18 and six peripheral strands (here illustrated generally as strand 20) of high tensile strength steel wire strand. For purposes of example only, when manufacturing 795 MCM overhead transmission conductor cable according to the present invention, a first strand 18 of aluminum or zinc coated steel wire having a diameter of about 0.135 inches, an ultimate tensile strength of at least 225 ksi exhibiting about 200 ksi at 1% elongation and about 3 to about 5 percent elongation (10-inch gage) may be used. Similar steel wires comprise the remaining strands 20, which are stranded with a twist along the length thereof as is known.

The electrically conductive aluminum portions of the overhead transmission conductor 10, 12 are formed from an aluminum or aluminum alloy rod 22. Such rod is preferably continuously cast and rolled in the known manner to form a rolled rod intermediate product of a size in the range of about ⅜-inch (10 millimeters) to about 1-inch (25 millimeters) in cross-sectional diameter. Continuously cast and rolled rod and the manufacturing processes therefore are well known. The aluminum metal raw material for the rolled rod is selected to ensure sufficient conductivity in the finished overhead transmission conductor cable products according to this invention, and especially for products characterized by high conductivity of 64% International Annealed Copper Standard (IACS) minimum conductivity specification. This rod 22 may be produced from ingots having an analysis according to TABLE V:

TABLE V

| ELEMENT | WEIGHT PERCENT (MAXIMUM) |
|---|---|
| Iron | 0.13 |
| Silicon | 0.06 |
| Manganese[1] | 0.003 |
| Titanium[1] | 0.005 |
| Vanadium[1] | 0.008 |
| Zinc | 0.03 |
| Gallium | 0.03 |
| Copper | 0.002 |
| Chromium[1] | 0.002 |
| Nickel | 0.003 |
| Aluminum[2] | 99.80 |

[1]Total of manganese, titanium, vanadium, and chromium not to exceed 0.015 weight percent. Total of all trace elements other than silicon, iron, and nickel not to exceed 0.08 weight percent.
[2]Minimum weight percent.

Deviations from the analysis presented in Table V may be tolerated and still produce an acceptable conductivity level in the finished rod product; however, it is preferred that the ingot analysis be restricted to the above analysis.

Figure 3:
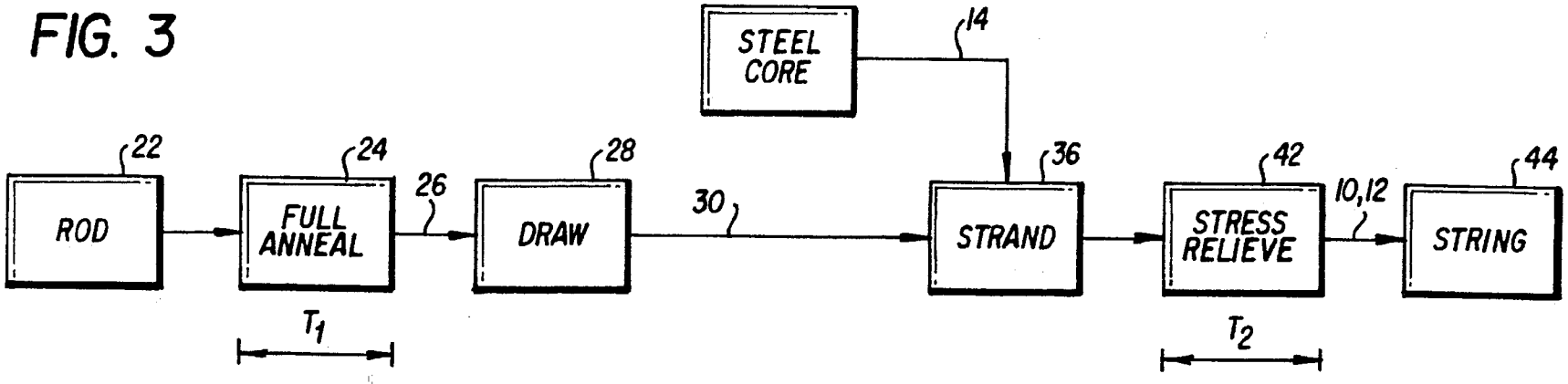
FIG. 3 is a diagram which illustrates the processing step sequence of the present invention.

The finished aluminum rod product 22 is then annealed at step 24 by conventional methods at an elevated temperature for a time period sufficient to assure recrystallization resulting in a reduction of the tensile strength to approximately 90 ksi or less in the annealed rod 26. The rod is to be fully annealed, or dead soft. The annealing step 24 occurs within the time frame identified as T1 in FIG. 3; that is, before drawing in step 28.

The annealed rod 26 is next drawn to a desired size in a drawing process step 28 to introduce strain hardening in the wire, producing a wire 30 of a strength in the range of about 20 ksi. The preferred drawing process step may include multiple individual steps of drawing the wire to the desired size; these individual drawing steps are collectively called the "drawing step" 28 herein. Either round conductor wires 32 or trapezoidal conductor wires 34 may be used, as desired.

When the overhead conductor 12 is formed of one or more layers of wire having a trapezoidal cross section as in FIG. 2, shaping must occur in addition to cross section reduction by the drawing process step 28. This shaping operation normally takes place in conjunction with the drawing step 28 prior to the stranding operation. However, trapezoidal wire 34 may also be formed in a separate rolling step (not shown), or as an initial step 36 of the stranding operation by rolling.

In the stranding operation at step 36, the conductor wires 30, which can be in the shape of either round or trapezoidal conductor wires 32, 34 (respectively) are formed into at least one layer 38 having a spiral twist, or lay, over the stranded steel cable 14 which forms the core. One or more additional layers 40 et cetera are added until the full overhead transmission conductor cable 10, 12 construction is completed.

It will be appreciated by those of ordinary skill in the art that the cross-sectional width and side to bottom angles of the trapezoidal wires 34 are closely related to the inner and outer diameters of the lays.

Subjecting the conductor wires 32, 34 to the stranding step 36 adds a slight degree of strain-hardening due to the tensions inherently induced by and necessary in the normal stranding operation, and to any work hardening resulting therefrom. Stranding is completed before adjusting the conductors to their final condition of temper.

As a result of hardening occurring before and during the stranding process step 36, it is necessary to subject the aluminum components of the cable 10, 12 to a stress-relieving/annealing heat treatment (step 42) at moderate temperatures to produce a "O" temper, dead-soft condition in the aluminum components. Since the aluminum components enclose the steel strand core 14, this step must be accomplished at temperatures which do not undesirably affect the steel strand core 14 or its protective coating 16.

Figure 4:
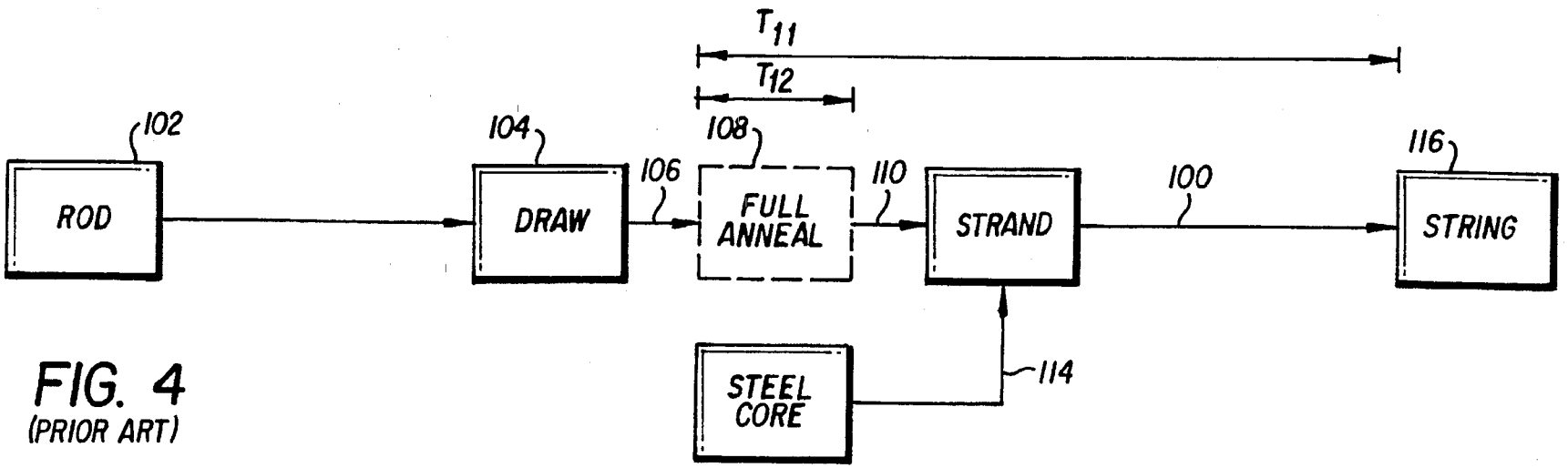
FIG. 4 (PRIOR ART)
FIG. 4 is a diagram which illustrates the processing step sequence of a prior art process.

Applicants prefer that the stress-relieving/annealing treatment step 42 be performed at about 600 degrees F. for zinc coated steel strand for a period of about six to about 14 hours, and preferably from about 6 to about 10 hours. The stress-relief/anneal treatment 42 can be performed at a temperature as high as about 800 degrees F. for the same periods for aluminum coated steel strand. Exercise of due care is necessary to avoid deleterious effects of these high temperatures on the steel material or the steel coatings. The stress-relieving/annealing step 42 must be performed within the time frame T2 (FIG. 4) between stranding 36 and string-up 44, and may be performed before a reeling or coiling step as occurs in preparing the 35 product for shipment.

The present invention comprehends a lower temperature stress-relieving/annealing heat treatment at this stage, rather than performing a full, higher temperature annealing step at this time, as is taught by the prior art.

After the overhead transmission conductor cable 10, 12 is successfully heat treated, it may be delivered to the field on reels (not shown) ready for the stringing up step, 44.

Properly performed, these process steps will produce an aluminum overhead transmission conductor cable 10, 12 having a surprisingly high conductivity of about 64% IACS or greater. Other characteristics of the cable 10, 12 produced according to the invention disclosed include improved corrosion resistance, reduced electrical losses and greater current capacity for a given cable cross section, high temperature operation, reduced tension creep, improved thermal-related sag, self-damping, and fatigue resistance characteristics.

TEST SAMPLES

Samples of a 795 MCM overhead transmission conductor cable made according to the present invention were submitted for testing. The conductor wires of the respective cable samples were drawn from annealed rod and stranded thereafter. Round conductor wires were used in the manufacture, and stranded under normal circumstances before being subjected to a stress-relieving/annealing heat treatment. In this first example, the overhead transmission conductor cable was subjected to a stress-relieving/annealing heat treatment The 795 MCM samples were identical except for heat treatment processes to which they were subjected. The sample were composed of six steel wires stranded over a single steel wire, a first inner layer of 10 round aluminum conductors, and a second layer of 16 round aluminum conductors. The conductor wire properties of the cables are discussed below.

The 795 MCM overhead transmission conductor cable sample steel strand wire properties are also given below. An average value for the steel strand outer layers is given as well as the inner strand value, along with an average of all 7 strands in the core.

EXAMPLE 1

A first sample of 795 MCM cable made according to the present invention was submitted for analysis according to accepted industry practices. Several important characteristics of the conductor wires were tested, including ultimate tensile strength, percent elongation, and conductivity. Important characteristics of the steel strand core were tested according to industry practices as well, including ultimate tensile strength, stress at 1 percent elongation, and percent elongation.

In this first example, the overhead transmission conductor cable was subjected to a stress-relieving/annealing heat treatment at 600 degrees F. for a period of 6 hours.

The aluminum conductor strands of the as-stranded cable exhibited properties consistent with wire drawn from annealed rod. The conductor wires were fully annealed. Electrical conductivity was determined for each of the conductor wires; the range of variation in electrical conductivity among all conductor wires in the sample was extremely small: from 64.0% IACS to 64.1% IACS, or 0.1%. The conductor wire properties of this first example are given in Table VI. Average values for the outer and inner layers of conductor wires are given separately, along with an overall average value of all the conductor wires. Similarly, the steel strand wire properties are given in Table VII.

TABLE VI

| Layer | Strand Diameter[1] | UTS[2] (KSI) | % Elong'n (10" Gage) | Conductivity (% IACS) |
|---|---|---|---|---|
| Outer (avg) | 0.174 | 8.9 | 33.5 | 64.1 |
| Inner (avg) | 0.174 | 8.9 | 33.3 | 64.1 |
| Overall (avg) | 0.174 | 8.9 | 33.4 | 64.1 |

Notes:
[1]Diameter in inches.
[2]Ultimate tensile strength.

TABLE VII

| Layer | Strand Diameter[1] | UTS[2] (KSI) | Stress @ 1% Elong'n (KSI) | % Elong'n (10" Gage) |
|---|---|---|---|---|
| Outer (avg) | 0.135 | 240.6 | 217.1 | 4.8 |
| Core (avg) | 0.135 | 237.1 | 214.4 | 4.5 |
| Overall (avg) | 0.135 | 240.1 | 216.7 | 4.8 |

Notes:
[1]Diameter in inches.
[2]Ultimate tensile strength.

EXAMPLE 2

A second sample of the same 795 MCM overhead transmission conductor cable material made according to the present invention was subjected to a heat treatment at 600 degrees F. for a period of 10 hours, and submitted for standard analysis. The same important characteristics of the conductor wires and of the steel strand core were tested in the second sample as well.

The aluminum conductor strands of the as-stranded cable exhibited properties consistent with wire drawn from annealed rod in the second sample as well; the conductor wires were fully annealed. Electrical conductivity was again determined for each of the conductor wires; the range of variation in conductivity among all conductor wires in the sample was again extremely small: from 64.0% IACS to 64.1% IACS, or a range of only 0.1%. The conductor wire properties of this second sample are given in Table VIII. Average values for the outer and inner layers of conductor wires are given separately, along with an overall average value of all the conductor wires. Similarly, the steel strand wire properties are given in Table IX.

TABLE VIII

| Layer | Strand Diameter[1] | UTS[2] (KSI) | % Elong'n (10" Gage) | Conductivity (% IACS) |
|---|---|---|---|---|
| Outer (avg) | 0.174 | 8.9 | 33.1 | 64.1 |
| Inner (avg) | 0.174 | 8.8 | 34.1 | 64.1 |
| Overall (avg) | 0.174 | 8.8 | 33.5 | 64.1 |

Notes:
[1]Diameter in inches.
[2]Ultimate tensile strength.

TABLE IX

| Layer | Strand Diameter[1] | UTS[2] (KSI) | Stress @ 1% Elong'n (KSI) | % Elong'n (10" Gage) |
|---|---|---|---|---|
| Outer (avg) | 0.135 | 239.0 | 215.3 | 5.0 |
| Core (avg) | 0.135 | 237.0 | 212.7 | 5.0 |
| Overall (avg) | 0.135 | 238.7 | 215.0 | 5.0 |

Notes:
[1]Diameter in inches.
[2]Ultimate tensile strength.

EXAMPLE 3

A third sample of 795 MCM overhead transmission cable made according to the present invention was subjected to a heat treatment at 600 degrees F. for a period of 14 hours, and submitted for standard analysis. The same important characteristics of the conductor wires and of the steel strand core were tested.

The aluminum conductor strands of the third sample of as-stranded cable exhibited properties consistent with wire drawn from annealed rod as in the first and second samples; the conductor wires were fully annealed. Electrical conductivity was determined for each of the conductor wires; the range of variation was again extremely small; from 64.0% IACS to 64.1% IACS, or a range of only 0.1%. The conductor wire properties of this third sample are given in Table X. Average values for the outer and inner layers of conductor wires is given separately, along with an overall average value of all the conductor wires. Similarly, the steel strand wire properties are given in Table XI.

TABLE X

| Layer | Strand Diameter[1] | UTS[2] (KSI) | % Elong'n (10" Gage) | Conductivity (% IACS) |
|---|---|---|---|---|
| Outer (avg) | 0.174 | 8.9 | 33.1 | 64.1 |
| Inner (avg) | 0.174 | 8.9 | 34.9 | 64.1 |
| Overall (avg) | 0.174 | 8.9 | 33.8 | 64.1 |

Notes:
[1]Diameter in inches.
[2]Ultimate tensile strength.

TABLE XI

| Layer | Strand Diameter[1] | UTS[2] (KSI) | Stress @ 1% Elong'n (KSI) | % Elong'n (10" Gage) |
|---|---|---|---|---|
| Outer (avg) | 0.135 | 241.2 | 217.1 | 4.9 |
| Core (avg) | 0.135 | 237.2 | 213.1 | 5.5 |
| Overall (avg) | 0.135 | 240.7 | 216.5 | 5.0 |

Notes:
[1]Diameter in inches.
[2]Ultimate tensile strength.

Figure 5:
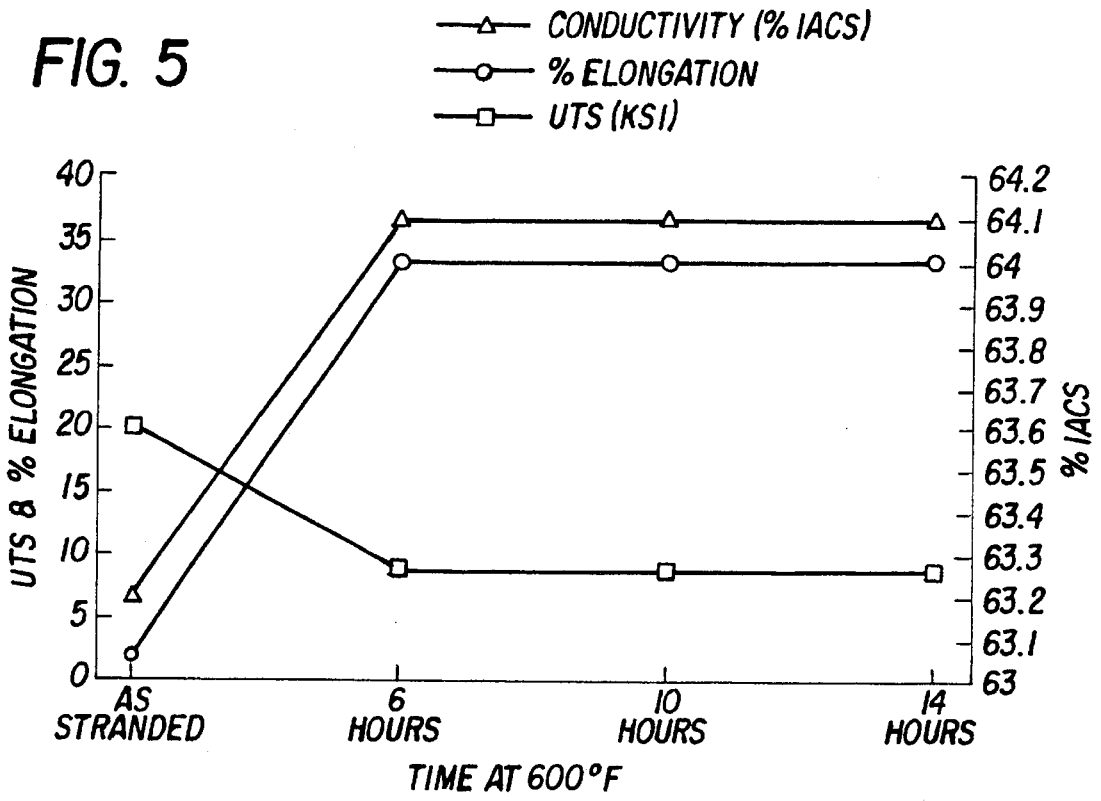
FIG. 5 is a diagram showing the conductor wire characteristics for the cable of the present invention with respect to stress relief time.
Figure 6:
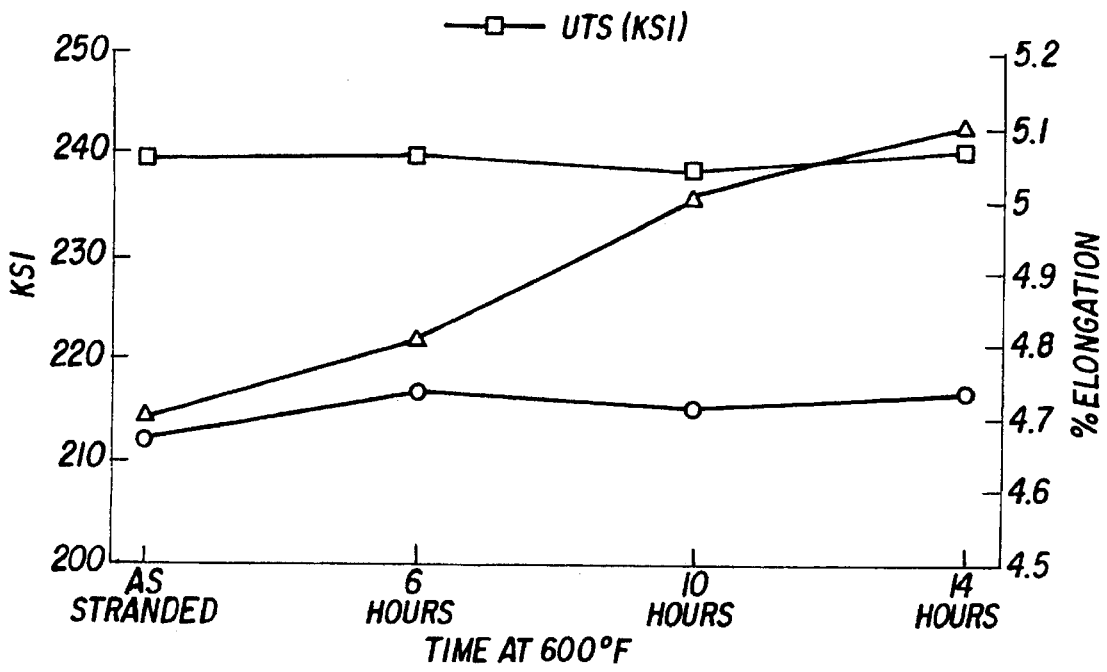
FIG. 6 is a diagram showing the steel strand core wire characteristics for the cable of the present invention with respect to stress relief/anneal time.

FIGS. 5 and 6 reflect the data derived from testing of the above-three samples, illustrating the effects of the stress-relief/anneal heat treatment on the conductor wires and the steel strands of the core.

FIG. 5 shows that the conductors wires of all three samples substantially fully reached their respective end values at the six-hour point according to Examples 1–3, with little or no change through a 14-hour stress-relief/anneal heat treatment. The conductor wires reached the 64.1% IACS conductivity level and retained this level after the full stress-relief/anneal period prescribed, i.e., 14 hours. FIG. 5 also reveals that all three samples were substantially unaffected in their ultimate tensile strength when subjected to a stress-relief/anneal heat treatment of from about six to about 14 hours.

FIG. 6 shows that the steel strands varied insubstantially in ultimate tensile strength and stress at 1 percent elongation, while elongation percentage increased slightly depending on the duration of the stress relief treatment.

Although only preferred embodiments are specifically illustrated and described herein, it will be appreciated that many modifications and variations of the present invention are possible in light of the above teachings and within the purview of the appended claims without departing from the spirit and intended scope of the invention.

We claim:

1. The method of producing an improved overhead transmission conductor which comprises the steps of:

providing a stranded steel core;

annealing high-conductivity aluminum rod to the fully annealed state;

drawing the fully annealed rod to produce conductor wires;

stranding at least one layer of said conductor wires about the stranded steel core to form a cable, said stranding being performed without increased lubrication and in the absence of:

i) substantially reduced back-tension, ii) substantially reduced operating speeds, and iii) substantially enlarged closing dies, all as necessitated by fully annealed conductor wires; and thereafter stress-relieving/annealing the conductor wires by heat treatment at limited temperatures until the conductor wires are substantially dead soft wherein said overhead transmission conductor exhibits at least 64% IACS conductivity, without significant deleterious effect on the stranded steel core.

2. The method of claim 1, further including the step of shaping the conductor wires into generally trapezoidal cross-sections after the annealing step and before the stranding step.

3. The method of producing an improved overhead transmission conductor which comprises:

providing a stranded steel core;

annealing high-conductivity aluminum rod to the fully annealed state for a period of time sufficient to assure recrystallization thereof accompanied by tensile strength reduction below about 9000 psi;

drawing the fully annealed rod to produce conductor wires;

stranding at least one layer of said conductor wires about the stranded steel core to form a cable; and stress-relieving/annealing the conductor wires by heat treatment at limited temperatures until the conductor wires are substantially dead soft, without significant deleterious effect on the stranded steel core;

characterized in that the conductor wires exhibit an ultimate tensile strength in excess of 8500 psi following the stress relief/annealing step.

4. The method of claim 3, further including the step of shaping the conductor wires into generally trapezoidal cross-sections after the annealing step and before the stranding step.

5. An improved overhead transmission conductor produced by the process which comprises the steps of:

providing a stranded steel core;

annealing high-conductivity aluminum rod to the fully annealed state;

drawing the fully annealed rod to produce conductor wires;

stranding at least one layer of said conductor wires about the stranded steel core to form a cable, said stranding being performed without increased lubrication and in the absence of:

i) substantially reduced back-tension, ii) substantially reduced operating speeds, and iii) substantially enlarged closing dies, all as necessitated by fully annealed conductor wires; and thereafter stress-relieving/annealing the conductor wires by heat treatment at limited temperatures until the conductor wires are substantially dead soft wherein said overhead transmission conductor exhibits at least 64% IACS conductivity, without significant deleterious effect on the stranded steel core.

6. The method of claim 5, further including the step of shaping the conductor wires into generally trapezoidal cross-sections after the annealing step and before the stranding step.

7. An improved overhead transmission conductor produced by the process which comprises:

providing a stranded steel core;

annealing high-conductivity aluminum rod to the fully annealed state for a period of time sufficient to assure recrystallization thereof accompanied by tensile strength reduction below about 9000 psi;

drawing the fully annealed rod to produce conductor wires;

stranding at least one layer of said conductor wires about the stranded steel core to form a cable; and stress-relieving/annealing the conductor wires by heat treatment at limited temperatures until the conductor wires are substantially dead soft, without significant deleterious effect on the stranded steel core;

characterized in that the conductor wires exhibit an ultimate tensile strength in excess of 8500 psi following the stress relief/annealing step.

8. The method of claim 7, further including the step of shaping the conductor wires into generally trapezoidal cross-sections after the annealing step and before the stranding step.

* * * * *